United States Patent [19]

Naser et al.

[11] Patent Number: 4,702,641

[45] Date of Patent: Oct. 27, 1987

[54] MULTI-PURPOSE CONCRETE WORKING TOOL

[75] Inventors: Charles F. Naser, Atlanta; Steven L. Aldridge, Alpharetta, both of Ga.

[73] Assignee: Atlanta Concrete Accessories Inc., Mableton, Ga.

[21] Appl. No.: 858,317

[22] Filed: May 1, 1986

[51] Int. Cl.[4] ..... E01C 19/44

[52] U.S. Cl. ..... 404/97; 404/118; 15/235.8

[58] Field of Search ..... 404/97, 118, 107; 15/235.8 X

[56] References Cited

U.S. PATENT DOCUMENTS

| | | | |
|---|---|---|---|
| 1,021,557 | 3/1912 | Runner | 404/97 X |
| 1,590,342 | 6/1926 | Abram | 15/235.8 |
| 1,952,398 | 3/1934 | Tullis | 15/235.8 |
| 2,834,199 | 5/1958 | Freeman | 72/136 |
| 2,934,937 | 5/1960 | Bennett | 72/136 |
| 2,999,261 | 9/1961 | Lapham | 15/235.8 |
| 3,082,460 | 3/1963 | Haivala | 15/235.8 |
| 3,090,066 | 5/1963 | Ferrell et al. | 15/235.8 |
| 3,146,481 | 9/1964 | Chiuchiarelli | 15/235.8 |
| 3,729,765 | 5/1973 | Peterson | 15/235.8 |
| 3,798,701 | 3/1974 | Irwin et al. | 15/235.8 |
| 4,335,485 | 6/1982 | Paine et al. | 15/235.8 |
| 4,520,527 | 6/1985 | Maggio et al. | 15/235.8 |

OTHER PUBLICATIONS

"Techniques for Building Superflat Floors Demonstrated at World of Concrete", in *Concrete Construction*, Vol. 31, No. 5, May 1986, pp. 498–499.

*Primary Examiner*—William F. Pate, III
*Assistant Examiner*—Creighton Smith
*Attorney, Agent, or Firm*—Jones, Askew & Lunsford

[57] ABSTRACT

A multi-purpose concrete working tool can be used to strike off, consolidate, finish, and check a concrete surface to produce a very flat or super flat surface. The tool consists of a rectangular, hollow extruded magnesium blade between 8 and 12 feet long with sharp edges at each side of the bottom working surface. An elongated handle is attached to the blade by means of a pitch adjusting mechanism and lateral braces. Rotation of the handle continuously varies the pitch of the working surface of the blade between 0 and 30 degrees in either direction with respect to the concrete surface without changing the elevation of the handle. The tool weighs in excess of 20 pounds, exerts more than 0.075 psi on the concrete, and has sufficient blade rigidity to be used to strike off and consolidate a concrete surface.

6 Claims, 11 Drawing Figures

MULTI-PURPOSE CONCRETE WORKING TOOL

BACKGROUND OF THE INVENTION

This invention relates generally to tools for working concrete and more particularly concerns a multi-purpose concrete working tool which is capable of cutting, consolidating, finishing, and checking concrete slabs to produce a surface on the slab of unusual flatness.

For certain floor installations, it is necessary that the concrete floor or slab be both very flat and very level. For example, in a warehouse where automated or semi-automated stacking systems having long, vertically extending booms are operating on concrete floors, it is necessary that the floor in the aisles of such warehouses be as nearly flat and level as possible. If the concrete floor is not flat, the boom will tip from side to side as the equipment rolls across the uneven concrete surface. Consequently, in that and other applications, it has become necessary to produce floors which are "very flat" or "super flat".

In the 1986 edition of the American Concrete Institute's "Manual of Concrete Practice", Committees 117 (Tolerances) and 302 (Construction of Floors) revised their floor recommendations to embrace the use of "face floor profile numbers" ("F-numbers"). The F-number system of surface definition and control was developed by the Edward W. Face Company of Roanoke, Va. specifically to eliminate the numerous technical and legal problems routinely encountered with conventional straight-edge type tolerances for specifying flatness of concrete floors. The F-number system provides a uniform, rational system for specifying the flatness of a concrete floor.

Two separate F-numbers may be used to define the shape of the worst acceptable localized floor profile. The first F-number, "F(F)", is the flatness number and specifies the localized waviness or curvature of the floor observed in any two-foot section. The second F-number, "F(L)", specifies the localized levelness of the floor by restricting the maximum elevation difference to be observed between two points separated by ten feet. The following equations are used to determine the F-numbers for any specific floor:

$$F(F) = \frac{4.57}{\text{maximum floor curvature over } 24''}$$

$$F(L) = \frac{12.5}{\text{maximum elevation difference over } 120''}$$

While the range of possible F-numbers theoretically extends from 0 for a very poor surface to infinity for a surface of perfect flatness, the F-numbers of commercial floors usually fall between F-15 and F-45. The F-number scale is linear so that relative flatness of two different floors will be proportional to the ratio of their respective F-numbers. In general the following minimum F(F) numbers define grades of floors:

| | Minimum F(F) |
|---|---|
| Not critical | 18 |
| Average | 25 |
| Better Than Average | 35 |
| Very Flat | 50 |
| Super flat | 100 |

Conventionally, a concrete floor is finished by first using a screed to strike off the poured concrete to a predetermined elevation. Once the concrete has been screeded to elevation, a bull float is used to work the fine aggregate (fines) to the surface to produce a uniform, smooth textured surface. While the bull float produces a surface that is smooth in texture, as opposed to being abrasive, the bull float does not remove localized waviness in the surface, and in fact, may produce such waviness, thereby lowering the F-number of the surface. Once the surface has been worked by the bull float and the concrete has hardened to some degree, a power float is used to further smooth the texture of the surface. After the surface has been worked by the power float, a power trowel is used to further smooth the texture of the surface. The result of the bull float, power float, and power trowel is to provide a surface that is smooth in texture but yet may have a high degree of waviness, and consequently a low F-number indicating lack of flatness.

With the advent and adoption of the F-numbers for specifying and defining flatness for concrete floors and with the demand for very flat and super flat floors for certain critical installations, it has become necessary to provide a means for finishing the surface of a concrete slab to a high degree of flatness.

The prior art has not specifically addressed the problem of finishing a very flat or super flat floor. The Haivala U.S. Pat. No. 3,082,460 discloses a concrete working tool (paver's edge) which has an elongated hollow straight edge, ten or twelve feet long, with an elongated handle attached to it. The straight edge is lightweight and has a V-shaped leading edge and is primarily useful for checking the flatness of a finished surface. While the Haivala patent suggests that the tool can be used to strike off or cut concrete as well as check, the light weight of the tool and the inability to adjust the pitch of the edge remotely by the operator over a continuous and wide range of angles make the Haivala tool particularly unsuitable for any work other than very light finishing or checking.

The Tullis U.S. Pat. No. 1,952,398 also discloses a paver's edge with a straight edge set at a fixed angle to the handle. Consequently the angle of the straight edge cannot be varied over a sufficient range of angles to allow the tool to be used to strike off and consolidate a concrete surface. Moreover, the rounded edges of the straight edge will tend to float or ride up on high spots thus sacrificing accuracy during striking off of the concrete. The lack of pitch adjustment for the edge with respect to the concrete surface also means that the edge cannot be pushed to the center of the slab, but instead must be lifted to the center of the slab, thereby limiting the tool's weight to about 15 pounds or less.

A number of patents including Paine et al. U.S. Pat. No. 4,335,485, Irwin et al. U.S. Pat. No. 3,798,701, Maggio et al. U.S. Pat. No. 4,520,527, Chiuchiarelli U.S. Pat. No. 3,146,481, Ferrell et al. U.S. Pat. No. 3,090,066, Bennett U.S. Pat. No. 2,934,937, Freeman U.S. Pat. No. 2,834,199, Abram U.S. Pat. No. 1,590,342, Peterson U.S. Pat. No. 3,729,765, and Lapham U.S. Pat. No. 2,999,261, disclose bull floats or trowels with remotely adjustable pitch. Such devices cannot, however, strike off, consolidate, and check a concrete floor to produce an unusually flat surface.

SUMMARY OF THE INVENTION

It is therefore an object of the present invention to provide a multi-purpose concrete working tool which can be used for striking off or cutting the concrete surface, consolidating concrete fill in low spots, finishing the concrete surface, and checking the resulting finished surface.

In order to realize the objective of the present invention, there is provided a multi-purpose concrete working tool comprising an elongated, hollow rectangular blade member, 8 to 12 feet in length, having a working surface with sharp edges at either side and an elongated handle, being up to 18 feet in length, attached to the center of the elongated rectangular blade by means of a pitch adjusting mechanism. The pitch adjusting mechanism allows the pitch of the blade to be adjusted with respect to the concrete surface by rotating the handle without raising or lowering the handle. Consequently, the pitch of the blade member is remotely and continuously variable over a relatively wide range of angles, between 0 and 30 degrees in either direction, such that the bottom working surface and the front and rear sides of the blade member can be brought to the appropriate working angles for respectively striking off, consolidating, finishing, and checking the concrete surface without the operator having to lower or raise the handle. The blade member of the concrete working tool has a weight greater than 20 pounds and a working surface area that produces a pressure of at least 0.75 pounds per square inch (psi) on the concrete surface. The pressure exerted by the working surface is sufficient to consolidate concrete and to strike off concrete. Moreover, because the pitch is remotely adjustable over a range of angles, the blade can be pushed over the concrete surface to the center of the slab, the pitch can be reversed, and any build-up of concrete is captured by the front edge of the blade prior to the blade being retrieved. Consequently, there is no need to lift the tool to place it in the center of the slab, and therefore the weight of the tool is not limited by the ability of the workman to lift the blade at the end of the extended handle.

Other objects and advantages of the invention will become apparent upon reading the following detailed description and upon reference to the drawings.

DETAILED DESCRIPTION OF THE INVENTION

While the invention will be described in connection the the preferred embodiment, it will be understood that we do not intend to limit the invention to that embodiment. On the contrary, we intend to cover all alternatives, modifications, and equivalents as may be included within the spirit and scope of the invention as defined by the appended claims.

Figures 1, 2, 3:
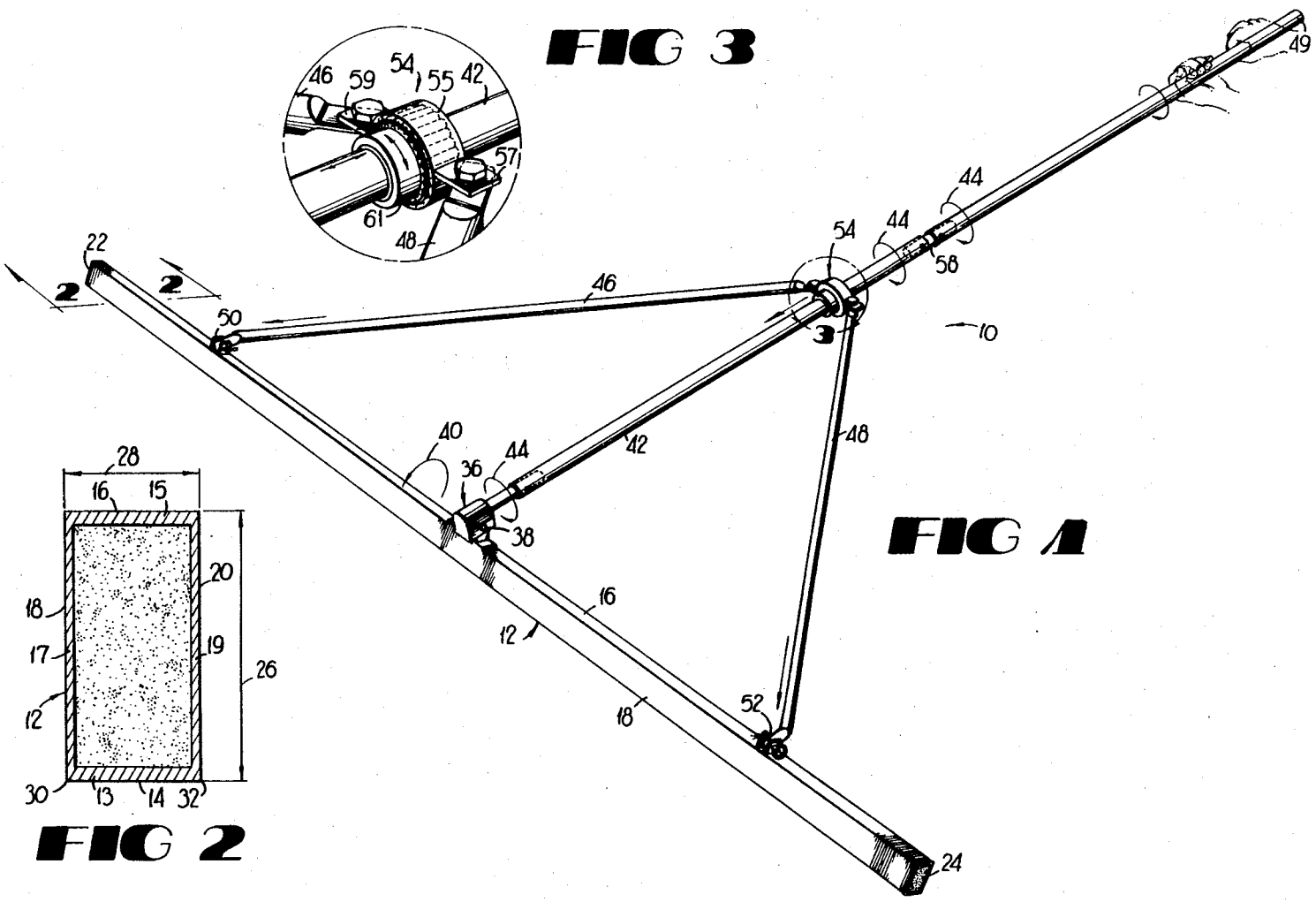
FIG. 1 is a perspective view of the concrete working tool of the present invention.
FIG. 2 is a cross-section of the blade member of the concrete working tool taken along line 2—2 in FIG. 1.
FIG. 3 is a detail of the handle bearing identified by circle 3 in FIG. 1.

Turning to FIG. 1, there is shown the multi-purpose concrete working tool 10 of the present invention. The concrete working tool 10 has an elongated blade member 12 with an elongated handle 42 attached thereto by means of a pitch adjusting head or mechanism 36 and by means of braces 46 and 48. The blade member 12 is hollow with a rectangular cross-section best shown in FIG. 2. The elongated blade member 12 is formed by extruding magnesium through a die to provide a blade member that is as straight and square as possible. The resulting extruded blade 12 has ends 22 and 24, a bottom wall 13 with a working surface 14, a top wall 15 with a top surface 16, a front wall 17 with a front surface 18, and a rear wall 19 with a rear surface 20. The open ends of the extruded blade member at 22 and 24 are filled with polystyrene foam or other suitable material in order to seal the ends from collecting concrete or other debris.

The magnesium blade 12 is extruded in lengths of either 8, 10, or 12 feet. The blade 12 has a height 26 of 4 inches and a width 28 of 1.875 inch. The front and rear walls 17 and 19 of the magnesium blade member are 0.1125 inch thick, and the top and bottom walls 15 and 13 are 0.189 inch thick. Consequently, the blade has a weight of 1.202 pounds per lineal foot. The top and bottom walls are thicker than the front and rear walls to reinforce the blade against bowing in an arc coplanar with the top and bottom walls. In addition the top wall is used to mount the handle, and the extra thickness on the bottom wall provides a more rigid working surface 14. The minimum thickness for the bottom wall is approximately 0.15 inch.

It should also be noted that where the front and rear surfaces 18 and 20 join the bottom working surface 14, the edges 30 and 32 are sharp edges and are not rounded in any fashion. The sharp edges 30 and 32 are important in order to allow the blade to perform its multi-purpose functions, especially striking off excess concrete.

The pitch adjusting means 36 is mounted on the top surface 16 of the blade 12 at the center point along the length of the blade. The adjusting means 36 is shown in three separate embodiments in FIGS. 4, 5, and 6, which will be described in greater detail.

The elongated tubular handle 42 is attached to the pitch adjusting means 36 for operating the pitch adjusting means. When the handle 42 is rotated as indicated by arrows 44 by the operator, the pitch adjusting means 36 causes the blade member 12 to pivot about axis 38 as indicated by arrow 40. Consequently, as the handle 42 is rotated, the angle between the length of the handle 42 and the blade varies so that the working surface 14 of the blade can be adjusted with respect to the concrete surface without raising or lowering the far end 49 of the handle. The operator can thus, by rotating the handle, remotely and continuously vary the pitch of the working surface 14 of the blade member over a relatively wide range of angles with respect to the concrete surface.

In order to provide stability, between the handle 42 and the blade 12, lateral braces 46 and 48 are pivotally mounted by means of clevis and pin mechanisms 50 and 52 respectively to the top surface 16 of the blade member 12. The braces 46 and 48 are connected to the handle 42 by means of a brace support assembly 54. As can best be seen in FIG. 3, the brace support assembly 54 comprises a round bearing housing 55 with lugs 57 and 59 attached on each side. The lugs 57 and 59 are bolted to braces 48 and 46 respectively. A ball bearing is retained inside of the bearing housing 55, and the tubular handle 42 is inserted through the bearing for rotation therein. A collar 61 is clamped onto the handle 42 to restrict the bearing's movement along the handle. The bearing in the brace support assembly allows the operator to rotate the handle freely while at the same time the braces 46 and 48 remain at a fixed position along the length of the handle 42 to provide lateral support to the blade 12.

The handle 42 is made of aluminum tubing 1.75 inch in diameter. The handle may be conveniently provided in sections which may be snapped together by means of a conventional connector 58 having spring loaded pins which engage mating holes in the joined handle sections to provide various handle lengths. The handle would typically have 3 six-foot sections for a total length of 18 feet. Because there is no need to lift the blade to the center of the slab, the handle length is not limited by the weight of the tool and the ability of a workman to lift and manipulate the blade at the end of a long handle.

Moreover, because the handle sections snap together without need of tools and because the clevis and pin mechanisms 50 and 52 disconnect without need of tools, the concrete working tool 10 can be quickly and easily broken down for transportation and reassembled for use.

Figure 4:
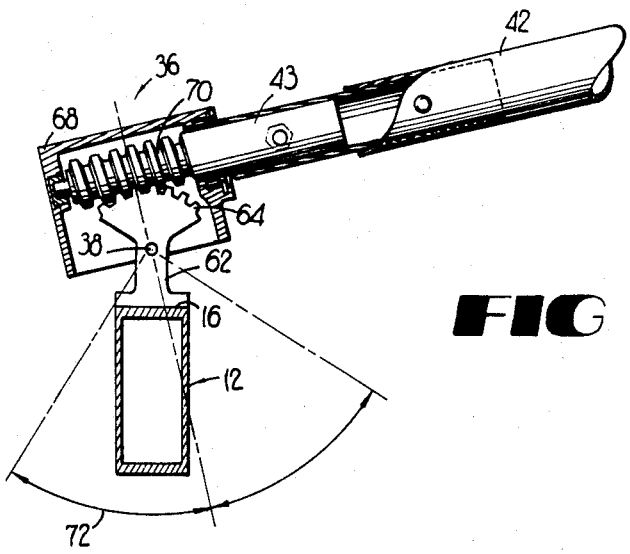
FIG. 4 is a section view of one embodiment of a pitch adjustment mechanism used in connection with adjusting the pitch of the blade member.

Turning to FIG. 4, there is shown the pitch adjustment means 36 which includes a lower bracket 62 mounted to the top surface 16 of the blade member 12. The lower bracket 62 has a gear segment 64. The lower bracket 62 is contained within and pivotally connected to a top bracket or housing 68 by means of pivot pin 38. The handle 42 is connected to a shaft 43 which is journalled into the housing 68 and terminates in a worm gear 70 that engages the gear segment 64. The shaft 43, the worm gear 70, and the gear segment 64 constitute drive means for pivoting the top bracket 68 with respect to the lower bracket 62. As the handle 42 and shaft 43 are rotated, the worm gear 70 causes the gear segment 64 to translate along the worm gear and to pivot about point 66 with respect to the top bracket 68. As a consequence, the pitch of the working surface 14 of the blade member 12 can be varied along arc 72 with respect to the length of the handle 42 and therefore with respect to the concrete surface.

Figure 5:
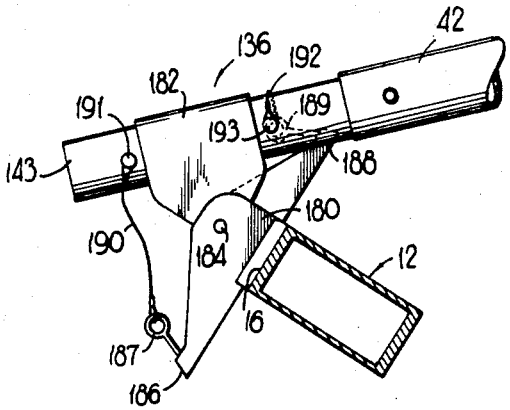
FIG. 5 is an alternative embodiment of the pitch adjustment mechanism used in connection with adjusting the pitch of the blade member.

FIG. 5 discloses an alternative embodiment showing a pitch adjustment means 136. Pitch adjustment means 136 includes a lower bracket 180 which is attached to the top surface 16 of the blade member 12. The lower bracket 180 is pivotally connected to a top bracket or sleeve assembly 182 at a pivot pin 184. The handle 42 is connected to a shaft 143 which is journalled into the sleeve assembly 182 for rotation with respect to the sleeve assembly 182. The lower bracket 180 has ends 186 and 188 to which are respectively attached cables or chains 190 and 192 by eye bolts 187 and 189 respectively. The cables 190 and 192 are connected to the shaft 143 by bolts 191 and 193 respectively and are wound around the shaft 143 on either side of the sleeve assembly 182. The cable 190 is wound around the shaft 143 clockwise (from the operator's view), and the cable 192 is wound around the shaft 143 counter-clockwise. The shaft 143 and the cables 190 and 192 comprise drive means for pivoting the sleeve assembly 182 with respect to the lower bracket 180. As the handle 42 is rotated, clockwise (from the operator's perspective), the cable 190 is taken up as it winds around the shaft 143, and the cable 192 is released as it unwinds from the shaft 143. Consequently, the lower bracket 180 pivots with respect to sleeve assembly 182, thereby adjusting the pitch of the working surface 14 of the blade member 12 with respect to the concrete surface without raising or lowering the end 49 of the handle 42.

Figure 6:
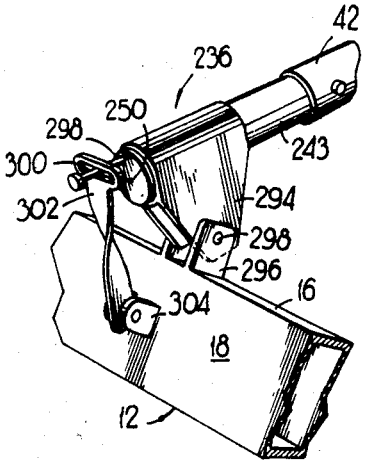
FIG. 6 is a third embodiment of the pitch adjustment mechanism used in connection with adjusting the pitch of the blade member.

FIG. 6 discloses a third embodiment of a pitch adjustment means 236 in which top bracket 294 is pivotally connected to lower bracket 296 by means of a pivot pin 298. The lower bracket 296 is mounted on the top surface 16 of the blade member 12. The handle 42 is connected to a shaft 243 which is journalled for rotation into the top bracket 294. A pin 298 extends from the end of the shaft 243 and is offset from the center of rotation 250 of the shaft 243. The pin 298 extends through and engages a slot 300 in an arm 302 which arm 302 is pivotally connected to the front surface 18 of the blade member 12 by means of a front bracket 304. The shaft 243, the pin 298, the slot 300, the arm 302, and the front bracket 304 comprise drive means for pivoting the top bracket 294 with respect to the lower bracket 296. As the handle 42 is rotated, the pin 198 eccentrically engages the slot 300 of arm 302 and causes arm 302 to vary the pitch of the working surface 14 of the blade member 12 with respect to the length of the handle 42 and thereby the concrete surface.

Figure 7:
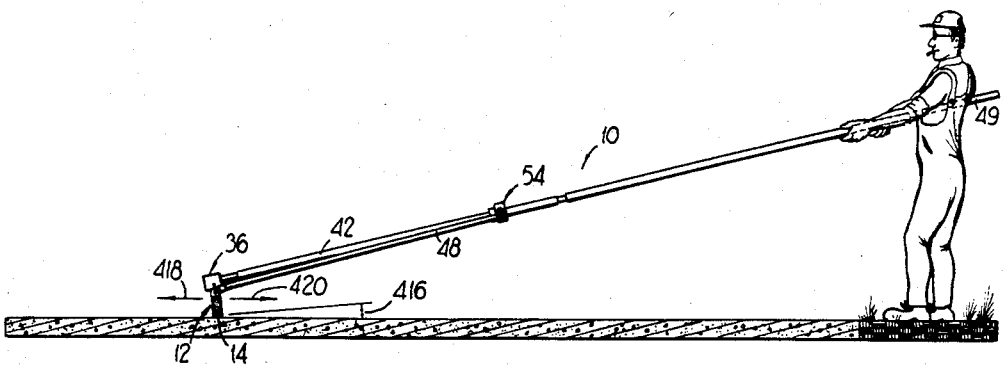
FIG. 7 is a side elevation view showing the working tool of the present invention being used to either finish or check a concrete surface.
Figure 8:
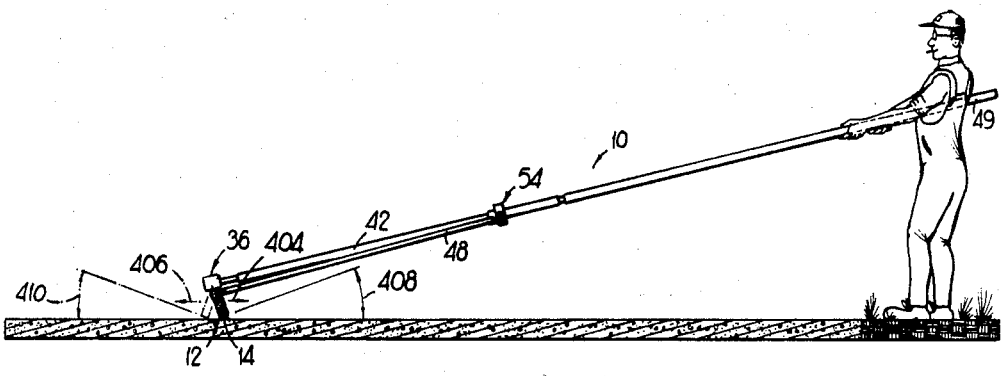
FIG. 8 is a side elevation view showing the working tool of the present invention being used to consolidate concrete.
Figure 9:
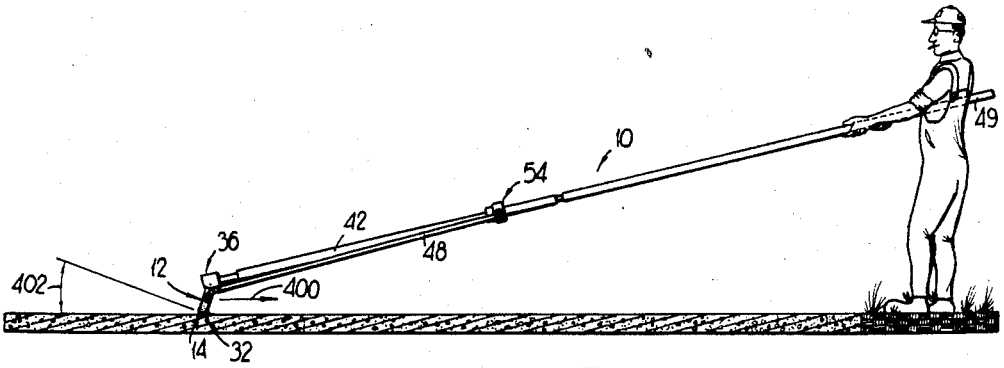
FIG. 9 of the present invention is a side elevation view showing the concrete working tool of the present invention being used to strike off or cut concrete.

FIGS. 7 through 9 show how the concrete working tool 10 of the present invention can be used for various purposes in connection with forming a very flat or super flat concrete surface or other flat concrete surface. In all three figures, the workman is holding the handle 42 of the tool at essentially the same height which a worker would automatically determine based on what is comfortable for that particular worker. Because the pitch of the blade is remotely and continuously adjustable, the pitch can be reversed at a remote position in the center of the slab so that any concrete build-up can be captured by the front edge 30 and retrieved. Consequently, there is no necessity to lift the tool of the present invention to set the blade in the center of a slab. Therefore, the tool can weigh anywhere from 20 to 30 pounds including 9.616, 12.02, or 14.424 pounds for an 8-foot, 10-foot, or 12-foot long blade.

FIG. 9 shows the workman using the working tool 10 of the present invention to strike off or cut a concrete surface. When striking off concrete, the blade member 12 is always pulled toward the workman as indicated by arrow 400. When striking off, the bottom working surface 14 is set at an angle between 15 and 20 degrees to the surface of the concrete as indicated by angle 402. The sharp rear edge 32 assures that the blade member cuts and strikes off those high spots which may exist in the concrete surface and does not float or ride up on high spots. Because the concrete working tool 10 has a weight between 20 and 30 pounds, it possesses sufficient weight with the sharp edge 32 exposed to the concrete to cut or strike off any high spots in a conventional concrete mix. Furthermore, because the blade assembly is of extruded magnesium, it will not deflect under loading generated when the working tool is used to cut or strike off concrete.

Particularly, when one compares the extruded magnesium blade of the present invention with its top and bottom walls that are 0.189 inch thick to those "lightweight" blades of the prior art which are designed to be lifted, one immediately appreciates the difference between the prior art blades such as the tool disclosed and claimed in the Haivala U.S. Pat. No. 3,082,460 and the tool of the present invention. If, for example, the blade member deflects along its length as it is being used to strike off concrete, that deflection will result in variation in flatness of the concrete if the pitch of the blade varies during the strike-off. If the blade becomes bowed from end to end with the ends trailing the center of the blade, changing the pitch of such a bowed blade by raising the handle even a little bit will cause the ends to dig in and the center to be raised up. Such a circumstance will result in a high spot near the center of the blade and low spots adjacent the ends of the blade.

In order to compare the performance of the working tool of the present invention to that of the commercial version of the lightweight tool disclosed in the Haivala U.S. Pat. No. 3,082,460, the following test was performed. Both blades were 12 feet in length. The Haivala tool weighed 14.6 pounds, and the tool of the present invention weighed 25.3 pounds. Both blades were anchored at their ends and subjected to pulling forces of from 30 to 120 pounds as indicated in Table I for the present invention and in Table II for the lightweight, commercial Haivala blade. The temporary and permanent deflections of each blade were measured and recorded:

TABLE I

| | (Present Invention) | |
|---|---|---|
| Tension on handle (Pounds) | Temporary Deflection (Inches) | Permanent Deflection (Inches) |
| 30 | 0.1563 | 0 |
| 50 | 0.2813 | 0 |
| 70 | 0.4688 | 0 |
| 90 | 0.5938 | 0 |
| 120 | 0.625 | 0 |

TABLE II

| | (Haivala) | |
|---|---|---|
| Tension (Pounds) | Temporary Deflection (Inches) | Permanent Deflection (Inches) |
| 30 | 0.4375 | 0 |
| 50 | 0.7500 | 0 |
| 70 | 1.0313 | 0 |
| 90 | 1.5000 | 0.3125 |

The normal working range for striking off concrete should be between 30 and 50 pounds of tension at the center of the blade. At even 30 pounds of tension, the lightweight Haivala blade experiences a temporary deflection of 0.4 inch which immediately indicates that the Haivala blade is unacceptable for striking off. A 0.4 inch deflection would likely cause the blade to exceed ordinary commercial specification which requires plus or minus 0.125 inch of variation in ten feet. Such a variation would certainly preclude using the Haivala tool to strike off and finish a very flat or super flat floor. Obviously as the working range approaches 50 pounds of tension, the performance of the Haivala blade becomes even worse. Finally under severe working conditions such as 90 pounds of tension, the lightweight Haivala blade actually experiences a permanent deflection and is no longer useful.

Consequently, the concrete working tool of the present invention with its extruded magnesium blade having substantial wall thicknesses and a weight of 1.202 pounds per linear foot provides sufficient strength to accommodate and allow the blade member to be used to strike off concrete when the blade is adjusted to the appropriate cutting angles of between 15 and 20 degrees from the horizontal concrete surface. Obviously, based on the test results, the lightweight prior art blades cannot provide that same function or performance.

FIG. 8 shows the concrete working tool 10 of the present invention being used to consolidate concrete which has been added to low spots on the slab. Consolidation can be carried out in either direction as indicated by arrows 404 and 406 in FIG. 8. In order to consolidate concrete, the working surface 14 is adjusted to a pitch of between 15 and 25 degrees from the horizontal as indicated by angle 408 for pulling and angle 410 for pushing. In order to consolidate concrete, it is necessary to exert sufficient pressure on the concrete to work the aggregate into the concrete mix. The pressure required in order to consolidate concrete is calculated by the following formula:

$$P=d\times t$$

where P is the pressure required to consolidate the concrete in pounds per square inch (psi), d is the density of the concrete in pounds per cubic inch (pci) and t is the thickness of the consolidation layer in inches. Typically, the density of concrete is 0.0839 pounds per cubic inch, and the consolidation depth is typically a minimum of 1 inch to assure that all aggregate is consolidated into the concrete mix. Consequently, the pressure required to be exerted on the concrete surface in order to consolidate is calculated as follows:

$$P=0.0839\times 1=0.0839 \text{ psi}$$

Based on that calculation, it is believed that the pressure for consolidation must at least exceed 0.075 psi.

The tool of the present invention with a 12-foot blade has a dead weight of 25.3 pounds, and the working surface 14 has an area of 270 square inches. Consequently, the pressure exerted by the concrete working tool 10 of the present invention when the working surface 14 is perfectly flat on the concrete to be consolidated is 0.0937 psi, thereby exceeding the necessary pressure for consolidating concrete to a depth of 1 inch. Obviously, as the blade is cocked at an angle, the blade's working surface area is diminished, and the pressure is increased, thereby making consolidation easier. By comparison, the commercial version of the lightweight Haivala tool, which weighs 14.6 pounds and has 216 square inches of working surface, exerts only 0.0676 psi of pressure and, as a result, cannot be used effectively to consolidate concrete.

FIG. 7 shows the workman using the tool 10 of the present invention for finishing or checking. When the tool is used for finishing, the bottom surface 14 is pitched at an angle 416 which may be anywhere from approximately 0 to 5 degrees from the horizontal. Finishing can be carried out in either direction as indicated by arrows 418 and 420. When the concrete working tool 10 of the present invention is used for checking, the pitch angle 416 is set between about 0 and 5 degrees. Checking is only accomplished by pulling the tool toward the workman in the direction indicated by arrow 420 so that the workman can observe the gap between the working surface 14 and the concrete surface.

The concrete working tool 10 of the present invention is used to form a very flat or super flat concrete floor in connection with the following process. After the concrete has been poured and the surface has been screeded to the predetermined elevation, the tool 10 is used to strike off and consolidate the concrete slab in a direction 90 degrees to the direction of the original screed. After the tool has been used to strike off and consolidate the concrete, the slab is allowed to set up to such an extent that a power float can be used to smooth the texture of the surface as is customary in conventional slab finishing. After the power float has been used to smooth the texture of the concrete, the concrete working tool 10 is employed as a finishing tool to repair the inevitable damage that the power float does to the flatness of the surface as it finishes the texture of the surface. After the tool of the present invention has been used to reflatten the surface, the power float may be used again or a power trowel may be employed in order to get the appropriate surface texture. After each use of the power float or power trowel, the tool of the present invention is again used to reflatten the surface and repair any damage inevitably done by the power float or trowel.

Of course, during any step in the process for preparing a very flat or super flat surface, the tool of the present invention allows the workman to set the pitch angle both remotely and continuously during any operation to precisely achieve the result desired. Again, that operation is in direct contrast to the operation of the fixed angle paver's edges of the prior art which are limited in their angular pitches by the height of the workman. With respect to the prior art Haivala tool, once the pitch of the blade has been set, there are substantial gaps in the angular pitch of the Haivala tool which render it incapable of striking off the slab (even if it were mechanically capable of enduring the strike-off tensions) and which render it incapable of consolidating the concrete surface.

Figure 10:
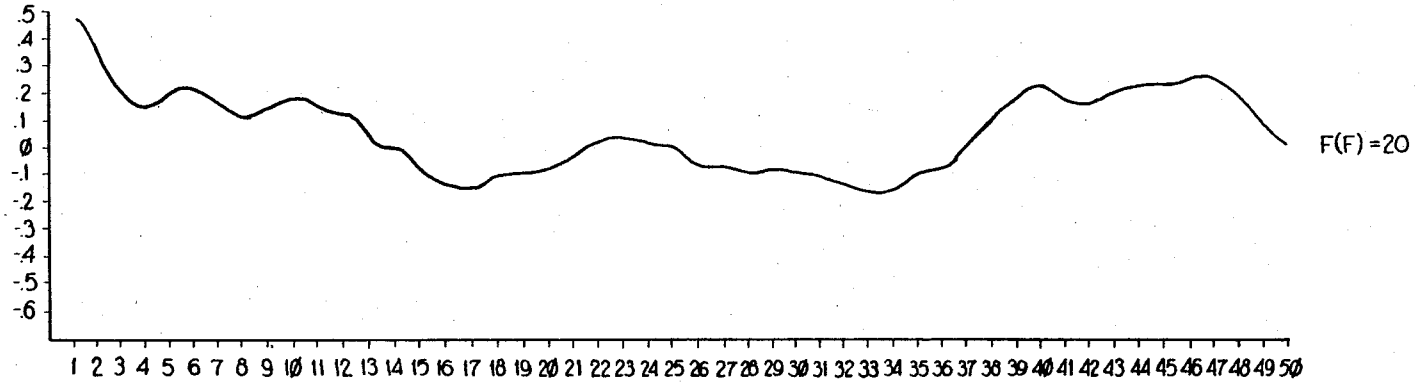
FIG. 10 is a graph showing a profile of the flatness of a commercial grade concrete floor finished without using the tool of the present invention and having an F-number of approximately 20.
Figure 11:
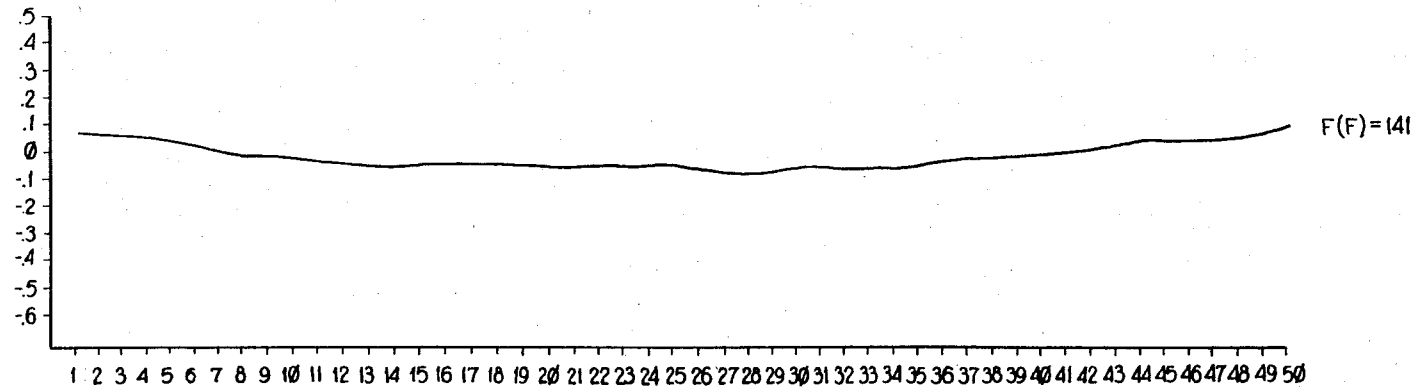
FIG. 11 is a graph showing the profile of the flatness of a super flat concrete floor finished by using the tool of the present invention and having an F-number of approximately 141.

The concrete working tool of the present invention has produced floors that are seven times more flat than conventional commercial grade concrete floors on grade. For example, at the 1986 World of Concrete Trade Show in Atlanta, Ga., a 50-foot long and 10-foot wide concrete floor was poured in place and finished using the concrete working tool of the present invention. After the floor had set up, a Dipstick measuring device manufactured by the Edward W. Face Company of Roanoke, Va. was used to check the flatness of the floor and to generate an F-number for the floor. FIG. 11 shows the computer profile generated from the measurements taken by the Dipstick measuring device. As can be seen, over the 50-foot length of the floor shown along the X-axis of the graph, the floor showed an overall variation of less than 0.125 inch as shown along the y-axis. When the readings shown on the graph in FIG. 11 were processed in accordance with the F-number calculation computer program, the F-number, F(F), was calculated to be 141, super flat. FIG. 10 shows the same measurements taken along a 50-foot section of the floor of the World Congress Center in Atlanta, Ga. where the concrete show was being held. The concrete floor of the World Congress Center is a typical commercial grade floor which would be described as good. As can be seen from FIG. 10, qualitatively at least, there is a remarkable difference in the flatness of the floor. Quantitatively, when the Dipstick measurements were used to calculate the F-number, F(F), the commercial floor had an F-number of 20. Stated another way, the concrete floor made using the tool of the present invention is seven times as flat as the commercial grade concrete floor of the World Congress Center.

A further example of the ability of the tool of the present invention to provide flat floors is demonstrated by a construction project undertaken by the inventors of the present invention in which 100,000 square feet of slab on grade for a warehouse was poured and finished using the tool of the present invention. After carrying out extensive Dipstick measurements over the entire slab, the worst F-number, F(F), generated was 65; the best F-number, F(F), for the slab was 133; and the average F-number, F(F), was 82. Again, the slab produced using the tool of the present invention was very flat and four times flatter than the conventional commercial grade concrete floor found in the World Congress Center.

We claim:

1. A multi-purpose concrete working tool for working a planar concrete surface comprising:

(a) an elongated, straight blade member having
  i. a length;
  ii. a midpoint;
  iii. a bottom working surface capable of being oriented at an angular pitch with respect to the concrete surface;
  iv. front surface; and
  v. a rear surface; wherein the bottom working surface exerts a pressure of at least 0.075 psi when the working surface is flat on the concrete surface and the bottom working surface joins the front and rear surfaces respectively to form a sharp front edge and a sharp rear edge;

(b) an elongated handle having a length, a first end, and a second end;

(c) lateral brace means having a first end connected at a point along the length of the handle and a second end pivotally connected to the blade member at a point displaced from the midpoint of the blade member; and (d) pitch adjustment means comprising:
  i. lower bracket means secured to the blade member adjacent the midpoint; and
  ii. top bracket means pivotally connected to the lower bracket means and including drive means operably interconnecting the lower bracket means and top bracket means for pivoting the lower bracket means with respect to the top bracket means, wherein the first end of the handle is connected to the drive means so that the pitch of the blade member can be remotely and continuously varied over a range of angles while the second end of the handle remains at a fixed elevation above the concrete surface.

2. The concrete working tool of claim 1, wherein the pitch is remotely and continuously variable through a range of angles between 0 and 30 degrees with respect to both the sharp front and sharp rear edge.

3. The concrete working tool of claim 2, wherein the drive means includes a rotatable shaft which is connected to the handle and controlled by rotation of the handle, and the lateral brace means further includes a bearing means journalled onto the handle for rotationally connecting the first end of the lateral brace means to the handle.

4. The concrete working tool of claim 1, wherein the weight of the tool is at least 20 pounds.

5. The concrete working tool of claim 1, wherein the blade member is extruded magnesium, is hollow, has a uniform rectangular cross-section with top, bottom, front, and rear walls, and is between 8 and 12 feet in length, and the top and bottom walls are at least 0.150 inch in thickness and deflects less than 0.4 inches at its center when subjected to 50 pounds tension at the center.

6. The concrete working tool of claim 1, wherein the handle comprises disconnectable sections and has a total length of up to 18 feet.

* * * * *